United States Patent [19]

Hellat et al.

[11] Patent Number: 4,805,411

[45] Date of Patent: Feb. 21, 1989

[54] COMBUSTION CHAMBER FOR GAS TURBINE

[75] Inventors: Jaan Hellat, Baden-Rütihof; Jakob Keller, Dottikon, both of Switzerland

[73] Assignee: BBC Brown Boveri AG, Baden, Switzerland

[21] Appl. No.: 125,126

[22] Filed: Nov. 25, 1987

[30] Foreign Application Priority Data

Dec. 9, 1986 [CH] Switzerland ..... 4892/86

[51] Int. Cl.[4] ..... F02C 1/00; F02G 1/00

[52] U.S. Cl. ..... 60/733; 60/737; 60/746

[58] Field of Search ..... 60/732, 733, 737, 738, 60/746, 748

[56] References Cited

U.S. PATENT DOCUMENTS

| | | | |
|---|---|---|---|
| 3,872,664 | 3/1975 | Lohmann et al. | 60/746 |
| 4,012,904 | 3/1977 | Nogle | 60/737 |
| 4,052,844 | 10/1977 | Caruel et al. | 60/738 |
| 4,173,118 | 11/1979 | Kawaguchi | 60/733 |
| 4,292,801 | 10/1981 | Wilkes et al. | 60/733 |
| 4,374,466 | 2/1983 | Sotheran | 60/738 |
| 4,765,146 | 8/1988 | Hellat et al. | 60/758 |

FOREIGN PATENT DOCUMENTS

| | | |
|---|---|---|
| 0169431 | 1/1986 | European Pat. Off. . |
| 0193029 | 9/1986 | European Pat. Off. . |
| 2412120 | 9/1974 | Fed. Rep. of Germany . |
| 3217674 | 12/1982 | Fed. Rep. of Germany . |
| 2010407 | 6/1979 | United Kingdom . |
| 2013788 | 8/1979 | United Kingdom . |
| 2072827 | 10/1981 | United Kingdom . |
| 2073400 | 10/1981 | United Kingdom . |
| 2146425 | 4/1985 | United Kingdom . |

*Primary Examiner*—Louis J. Casaregola
*Assistant Examiner*—Timothy S. Thorpe
*Attorney, Agent, or Firm*—Burns, Doane, Swecker & Mathis

[57] ABSTRACT

In the combustion space of a combustion chamber of a gas turbine operated with liquid fuel, at least one after-burner (4) is employed in each case in combination with one or more primary burners (2, 2*a*). The after-burner (4) and at least its fuel spray cone (15), which acts directly into the central combustion chamber (6), are screened by an unswirled enveloping airstream (14) against the hot gases (13) from the combustion in the primary burners (2, 2*a*). The after-burner (4) itself is not automatically operating, i.e. the ignition of its mixture (14/15) takes place further downstream, preferably at the beginning of the mixing chamber (7), as a result of which a turbulence-free flow with uniform pressure and temperature profile is provided for acting on the turbine (9).

5 Claims, 2 Drawing Sheets

COMBUSTION CHAMBER FOR GAS TURBINE

FIELD OF THE INVENTION

The present invention relates to a combustion chamber of gas turbines for operation with liquid fuels.

BACKGROUND OF THE INVENTION

The present invention is a technical innovation in combustion chambers of gas turbines in which a dry, low-$NO_X$ combustion of liquid fuels in gas turbine combustion chambers is desired. To achieve a primary-side reduction of the $NO_X$ emission values in operating gas turbine combustion chambers with gaseous fuels, four principles are basically known:

(a) the permix combustion;

(b) the two-stage combustion in which a substoichiometric combustion is initiated in a first stage, which is followed in a second stage by a rapid admixture of air and a superstoichiometric secondary-combustion;

(c) the surface-type combustion in which the object is pursued of achieving as short a resident time of the gases in the reaction zone as possible;

(d) the injection of water or steam into the reaction zones to reduce the reaction temperatures. The low $NO_X$ emission values still tolerated by the legislature can at most be maintained in the case of a laminar combustion if the residence time of the gas particles in hot oxygen-rich zones is as short as possible, namely no more than a few milliseconds. On the other hand, in order that low CO emission values can be achieved, the temperature in the reaction region must not fall below a certain limit. In addition, it is known that the avoidance of $NO_X$ can be achieved with combustion chamber designs with graduated combustion. This graduation may mean either a substoichiometric primary combustion zone with subsequent secondary-combustion at low temperatures or the stepwise switching on of superstoichiometrically operated burner elements. The graduation always requires also a powerful mixing mechanism. The principle of the premix combustion has proved to be the technically best technique for the $NO_X$ reduction in the combustion of gaseous fuels. A premix combustion may, for example, consist in a premix process proceeding inside a number of tubular elements between the fuel and the compressor air before the actual combustion process takes place downstream of a flame holder. As a result of this, the emission values for pollutants originating from the combustion can be considerably reduced. The combustion with the highest possible fuel-air ratio (due on the one hand to the fact that the flame does in fact continue to burn and, on the other hand, to the fact that not too much CO is produced) reduces, however, not only the pollutant quantity of $NO_X$, but, in addition, effects a consistent reduction of other pollutants, namely, as already mentioned, of CO and of uncombusted hydrocarbons. In the known combustion chamber, this optimization process can be pursued, in relation to lower $NO_X$ emission values, by keeping the space for combustion and the secondary reaction much longer than would be necessary for the actual combustion. This makes it possible to choose a large fuel-air ratio, in which case although larger quantities of CO are then first produced, they are able to react further to form $CO_2$ so that, finally, the CO emissions nevertheless remain low. On the other hand, however, because of the high fuel-air ratio, lower $NO_X$ emission values actually occur. With such a premix combustion technique it is only necessary to ensure that the flame stability, in particular at partial load, does not impinge on the extinction limit because of the very lean mixture and the low flame temperature resulting therefrom. Such a precaution may, for example, by implemented on the basis of a fuel regulation system and also the stepwise starting of premix elements as a function of the engine speed. Because of the short ignition delay times preceding self ignition of liquid fuels, for example diesel, a premix combustion of liquid fuels is increasingly less suitable since the trend in modern gas turbine construction is aimed at a further increase of the combustion chamber pressure, the choice of which is already very high even today. Here the invention intends to provide a remedy.

OBJECTS AND SUMMARY OF THE INVENTION

As it is characterized in the claims, the invention is based on the object of achieving comparable low $NO_X$ emission values as in the case of combustion chambers operated with gaseous fuels in a combustion chamber of the type mentioned in the introduction without running the risk of a self ignition of the liquid fuels outside the combustion chamber. The advantage of the invention is essentially to be perceived in the fact that, in a simple manner, a system is made available which produces low $NO_X$ emission, said system managing without the per se fairly costly technique and infrastructure for achieving premixing.

The idea basically consists in providing a primary burner system and a secondary-burner system. The liquid fuel is injected directly into the combustion space. In the case of the after-burner, the injected fuel is screened with an envelope of air, this not being in this case an automatically operating burner. The secondary-burner, which is situated in a central chamber at the end of the primary burner chamber is in each case used in combination with one or more primary burners. The hot gases produced by the primary burners are not intended to be able to ignite the mixture produced by the after-burner in the immediate vicinity of the fuel jet of the after-burner in order to avoid a combustion at near-stoichiometric conditions.

This is catered for by the screening envelope of air which is unswirled and which initially screens the fuel mist emerging from the after-burner jet effectively against the outer hot gases. Ignition of the after-burner mixture is intended to be possible only if the liquid fuel introduced by the after-burner jet has become sufficiently extensively mixed with the screening envelope of air and with the hot gas containing air so that the combustion takes place in a lean mixture at low temperature. Advantageous and expedient further developments of the achievement of the object according to the invention are characterized in the subclaims.

BRIEF DESCRIPTION OF THE DRAWING

Exemplary embodiments of the invention are explained below by reference to the drawing. In the drawing.

DETAILED DESCRIPTION OF A PREFERRED EMBODIMENT

Figure 1:
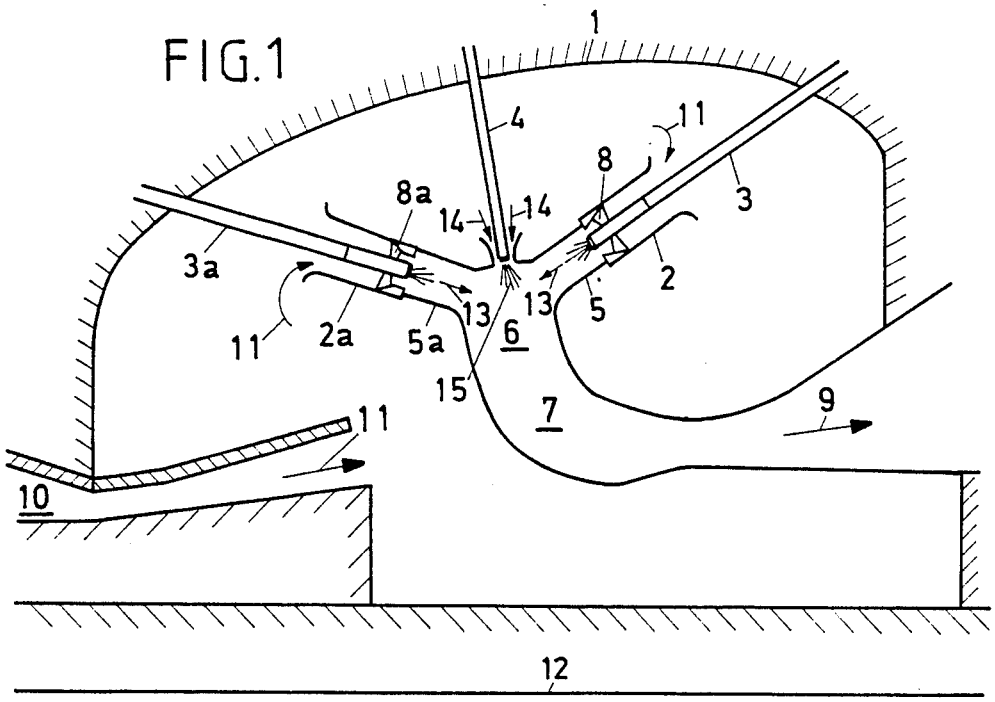
FIG. 1 is a schematic view of an annular cylindrical combustion chamber with primary and secondary-burners.

FIG.1 shows a combustion chamber for gas turbines which is accommodated in the gas turbine annular housing 1. If the entire combustion chamber is incorporated in a gas turbine annular casing 1, it is connected chamberwise with the compressed air 11 from the compressor 10. The gas turbine annular casing wall is designed to withstand the compressor final pressure. The geometrical shape of the combustion space is, as the axial section 12 is intended to illustrate, annularly cylindrical and consists of two primary combustion chambers 5, 5*a* disposed at the end which are disposed symmetrically and in a V shape with respect to the central combustion chamber 6. Of course, the primary combustion chambers 5, 5a may be situated in a horizontal plane with respect to the central axis of the central combustion chamber 6. The primary combustion chambers 5, 5*a* themselves are fitted at their face ends in the circumferential direction with a number, which depends on the rating of the combustion chamber, of primary burners 2, 2*a* disposed parallel to the axis. These consist essentially of a fuel line 3, 3*a* and a swirler 8, 8*a*.

Figure 2:
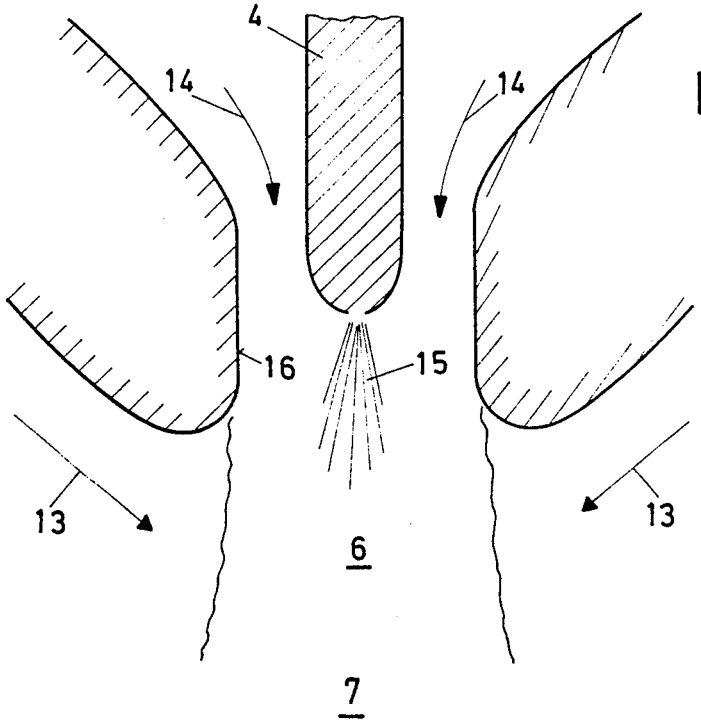
FIG. 2 is a schematic view of the environment of an secondary-burner.
Figure 3:
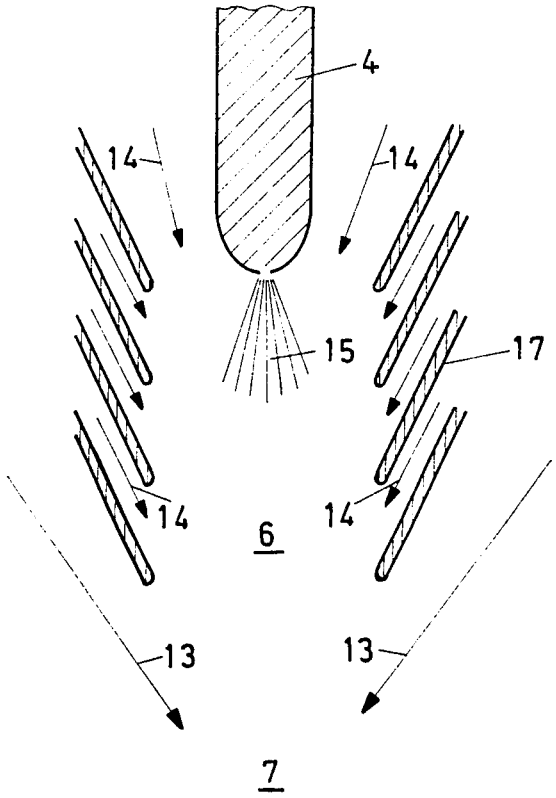
FIG. 3 is a schematic view of a further environment of an secondary-burner. All the elements which are not necessary for the immediate understanding of the invention have been omitted. The direction of flow of the media is denoted by arrows. In the various figures, identical elements are in each case provided with the same reference symbols.

Instead of a continuous annularly cylindrical primary combustion chamber 5, 5*a*, several self-contained combustion chamber units distributed on the circumference may be provided which in each case consists of a pair of twin burners with swirlers preferably oriented with opposite directions of rotation. This has the effect that an effective mixing process can be produced in the individual combustion chamber units, an annular cylindrical exit channel collecting the hot gases emerging from the individual combustion chamber units in order to feed them to the central combustion chamber 6. If the continuous annular cylindrical primary combustion chamber 5 and 5*a* shown here is provided, the primary burners 2 or 2*a* disposed next to each other parallel to the axis can be fitted alternately also with swirlers 8, 8*a* oriented with opposite directions of rotation. A secondary-burner 4 is in each case provided in combination with preferably two oppositely situated primary burners 2, 2*a*. From secondary-burner 4, liquid fuel 15 is directly injected into the combustion space and shielded with an envelope of air 14. The secondary-burner 4 is so designed that it does not operate automatically, i.e. it requires a permanent ignition for the combustion of its mixture. The hot gases 13 produced by the primary burners 2, 2*a* are intended not to be able to ignite the mixture 14/15 produced by the secondary-burner 4 in the immediate neighborhood of the fuel jet of the secondary-burner 4. This is catered for by the screening envelope of air 14 which should preferably be unswirled and initially screens the fuel mist 15 emerging from the secondary-burner jet effectively against the hot gases 13 of the primary burners 2, 2*a* arriving at that point. Ignition of the secondary-burner mixture 14/15 is intended to be possible only when the liquid fuel 15 introduced by the burner jet has become sufficiently intensively mixed with the screening envelope of air 14. The fuel-air ratio related to the fuel supply of the secondary-burner 4 and the envelope of air 14 is specified according to the same criteria as for a premix burner. In the case of this secondary-burner principle, the rapid intermixing of the hot gases 13, after they have initiated the initial external ignition of the secondary-burner mixture 14/15, play an important role in the stability of the combustion, for which reason care should be taken that the chosen momentum density ratio between primary burner gases 13 and secondary-burner mixture 14/15 is very high (far above 1). This ensures that an optimally designed secondary-burner 4 hardly produces any more $NO_x$ than a premix burner, while the primary burners 2, 2*a*, which must, of course, be automatically operating, for example designed as diffusion burners, give rise to substantially higher $NO_X$ emissions. For this reason, precautions should be taken in a gas turbine combustion chamber to supply as high a proportion as possible of the liquid fuel via the secondary-burners 4. The primary burners 2, 2*a* should therefore be designed as small as possible and should be operated with high fuel-air ratios: both techniques make it possible to keep the $NO_X$ emissions from the operation of the primary burners 2, 2*a* as low as possible. The logical result of this for the operation of a gas turbine combustion chamber is that the primary burners 2, 2*a* and the secondary-burners 4 should be operated in a graduated manner. Preferably, the secondary-burners 4 are switched on at a load point in the vicinity of zero load of the gas turbines. Between the switch-on point and maximum load, the load is regulated only via the fuel supply to the secondary-burners 4, it being possible in that case to initiate a stepwise reduction of fuel supply to the primary burners 2, 2*a* as after-burner load increases. The lower limit to the reduction of the fuel supply to the primary burners 2, 2*a* is set, on the one hand, by the extinction limit of the primary burners and, on the other hand, by the necessity that the temperature of the exhaust gas of the primary burners has to be sufficiently high to initiate the complete combustion of the secondary-burner fuel. The envelope of air 14 screens the secondary-burner 4 and also its liquid fuel spray cone 15 from the inflowing hot gases 13 from the primary burners 2, 2*a*. As already explained, the mixture 14/15 produced by the secondary-burner 4 is not intended to ignite in the immediate vicinity of the fuel jet 15 at near-stoichiometric conditions. Ignition of the secondary-burner mixture 14/15 is intended to be possible only if the liquid fuel 15 injected by the after-burner jet has become sufficiently intensively mixed with the screening envelope of air 14, i.e. downstream of the central combustion chamber 6. Further downstream there is located the mixing chamber 7 which ensures that a turbulent-free flow with uniform total pressure and temperature profile can be produced before the turbine 9 is acted upon. In principle, the length of the mixing chamber 7 is strongly dependent on the intensity of the mixing process: observations have revealed that a turbulence-free flow with uniform pressure is readily achieved after a length of about three diameters of the corresponding combustion chamber unit. As regards the optimum embodiment of the primary burners 2, 2a, reference is made to the description according to European Pat. No. 0,193,029, in particular, under FIG. 2. The achievement which can be seen in FIG. 2 is intended to protect the secondary-burner 4 more substantially against the inflowing hot gases 13 of the primary burners 2, 2*a*. For this purpose, the intake 16 of the screening air 14 into the combustion chamber is extended to such an extent that the liquid fuel spray cone 15 is screened at the same time. The hot gases 13 only flow towards the secondary-burner mixture 14/15 further downstream; at that point, the mixing of the liquid fuel 15 with the screening envelope of air 14 has advanced to such an extent that an ignition of said mixture 14/15 can take place. FIG. 3 shows a further variant of how the secondary-burner 4 and its liquid fuel spray cone 15 can be screened from the inflowing hot gases 13 in the region of the central combustion chamber 6. The screening air 14 flows, on the one hand, past the secondary-burner 4 and, on the other hand, laterally between several lamellae 17 into the central combustion chamber 6. Such a precaution offers the advantage that the mixing between liquid fuel 15 and screening air 14 is optimized upstream of the mixing chamber 7. The ignition of the mixture 14/15 then already takes place at the beginning of the mixing chamber 7 as a result of the hot gases 13 debauching at that point. Consequently, the entire length of the mixing chamber 7 remains available in order to provide a turbulence-free flow with uniform pressure and temperature profile for the turbine to be acted upon.

What is claimed is:

1. A combustion chamber of a gas turbine for operation with liquid fuels, the combustion chamber comprising:

a main combustion space defined within the combustion chamber and having an upstream end and a downstream end;

a secondary burner centrally positioned at the upstream end of the main combustion space and including fuel feed means for introducing a fuel mist into the main combustion space;

two primary burners symmetrically positioned with respect to the secondary burner, each of the primary burners including a primary combustion space which is positioned upstream of the secondary burner with respect to the main combustion space; and air supply means for supplying an unswirled stream of air enveloping the fuel mist as the fuel mist enters the main combustion space to protect the fuel mist from direct exposure to hot gases leaving the primary combustion space when the fuel mist is first introduced into the main combustion space.

2. The combustion chamber as set forth in claim 1, wherein the main combustion space and the two primary burners are each of annular cylindrical shape.

3. The combustion chamber as set forth in claim 1, wherein the two primary burners are positioned to define a V shape with respect to the central combustion space.

4. The combustion chamber as set forth in claim 1, wherein the combustion chamber is of an annular cylindrical shape, and further comprises a plurality of combustion chamber units each including two primary burners each having a swirler and being disposed laterally in the circumferential direction of the combustion chamber, the swirlers of each combustion chamber unit producing oppositely rotating turbulances.

5. The combustion chamber as set forth in claim 1, further comprising means for separating the fuel mist and the stream of air from the hot gases as the fuel mist enters the main combustion space.

* * * * *